US010943459B2

(12) United States Patent
Kurata

(10) Patent No.: US 10,943,459 B2
(45) Date of Patent: Mar. 9, 2021

(54) FALL-INTO-WATER ACCIDENT DETERMINATION SYSTEM AND FALL-INTO-WATER ACCIDENT DETERMINATION METHOD

(71) Applicant: SUZUKI MOTOR CORPORATION, Hamamatsu (JP)

(72) Inventor: Koji Kurata, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 16/890,743

(22) Filed: Jun. 2, 2020

(65) Prior Publication Data

US 2020/0388136 A1 Dec. 10, 2020

(30) Foreign Application Priority Data

Jun. 5, 2019 (JP) ..... JP2019-105263

(51) Int. Cl.
*G08B 21/08* (2006.01)
*G08B 29/18* (2006.01)

(52) U.S. Cl.
CPC ..... *G08B 21/088* (2013.01); *G08B 29/185* (2013.01)

(58) Field of Classification Search
CPC ..... G08B 21/088; G08B 29/185
See application file for complete search history.

(56) References Cited

U.S. PATENT DOCUMENTS

| | | | | |
|---|---|---|---|---|
| 9,290,144 | B1 * | 3/2016 | Cox | B60R 21/013 |
| 10,583,904 | B2 * | 3/2020 | Hulbert | A61B 5/14551 |
| 2013/0231805 | A1 * | 9/2013 | Kwong | B63H 25/42 701/21 |
| 2018/0040223 | A1 * | 2/2018 | Bodi | G08B 21/08 |
| 2019/0333356 | A1 * | 10/2019 | Boyle | G08B 21/088 |
| 2020/0020221 | A1 * | 1/2020 | Cutler | H04L 67/12 |
| 2020/0258367 | A1 * | 8/2020 | Jungmar | G08B 21/08 |

FOREIGN PATENT DOCUMENTS

JP 2003-40193 A 2/2003

* cited by examiner

*Primary Examiner* — Mohamed Barakat
(74) *Attorney, Agent, or Firm* — Stein IP, LLC

(57) ABSTRACT

There is provided a fall-into-water accident determination system including: a weight detector configured to be attached to an occupant of a vessel and configured to detect a weight applied to a foot of the occupant; a water detector configured to be attached to the occupant and configured to detect water; and a fall-into-water accident determinator configured to determine whether a fall-into-water accident in which the occupant falls into water from the vessel occurs. The fall-into-water accident determinator determines whether the weight changes based on a detection result of the weight detector. The fall-into-water accident determinator determines whether the occupant is immersed in water based on a detection result of the water detector. And the fall-into-water accident determinator determines that the fall-into-water accident occurs when the weight changes and the occupant is immersed in water.

15 Claims, 9 Drawing Sheets

FALL-INTO-WATER ACCIDENT DETERMINATION SYSTEM AND FALL-INTO-WATER ACCIDENT DETERMINATION METHOD

CROSS-REFERENCE TO RELATED APPLICATIONS

This application is based on Japanese Patent Application (No. 2019-105263) filed on Jun. 5, 2019, the contents of which are incorporated herein by way of reference.

BACKGROUND

The present invention relates to a fall-into-water accident determination system and a fall-into-water accident determination method capable of determining the occurrence of a fall-into-water accident in which an occupant falls from a vessel.

On water such as the sea, lakes and rivers, various activities including business such as fishery, fishing as a hobby and a game, cruises and water sports, or the like are performed by using a vessel. A fall-into-water accident in which a person who is on such a vessel and who participates in activities on water falls into water from the vessel, may occur. It should be noted that "falling into water" means falling to the water surface. When the fall-into-water accident occurs, if it is difficult for a person who has fallen into water to return to the vessel by himself or herself, another person must rescue the person. However, for example, when a person who is on the vessel alone and who participates in activities on water falls into water from the vessel, there may not be a person who rescues the person who has fallen into water around. Even in such a situation, a method capable of quickly rescuing the person who falls into water is desired.

In this point, Patent Literature 1 to be described below describes a water accident rescue support system including a transmitter that is carried by an operator acting in the water area and that transmits a signal, a monitoring terminal that receives the signal from the transmitter. In the monitoring terminal, there is an accident detection unit that detects the occurrence of a water accident of the operator by the signal received from the transmitter. In the water accident rescue support system, the transmitter is provided with a submergence sensor that detects the presence or absence of submergence of the transmitter itself, and a transmission unit that switches the signal transmitted from the transmitter from a normal signal to an emergency signal when submergence is detected. The monitoring terminal detects the water accident when the signal received from the transmitter is switched from the normal signal to the emergency signal, and notifies an external terminal of accident information of the water accident.

Patent Literature 1: JP-A-2003-40193

However, when the transmitter carried by a person on the vessel is exposed to a large amount of water, the transmitter will be in a state similar to being submerged. In the water accident rescue support system described in Patent Literature 1, when submersion of the transmitter is detected by the submersion sensor, the signal transmitted from the transmitter is changed from the normal signal to the emergency signal, and the water accident is detected by the change of the signal. Therefore, it is difficult for the water accident rescue support system to accurately distinguish between a case where the transmitter carried by the occupant on the vessel is exposed to a large amount of water and a case where the occupant falls into water from the vessel. Thus, it is considered that there may be a case where it is not possible to accurately determine the occurrence of a fall-into-water accident.

SUMMARY

The present invention has been made in view of, for example, the above-described problems, and an object thereof is to provide a fall-into-water accident determination system and a fall-into-water accident determination method that can accurately determine the occurrence of a fall-into-water accident.

In order to solve the above-described problem, a fall-into-water accident determination system of the present invention includes: a weight detector configured to be attached to an occupant of a vessel and configured to detect a weight applied to a foot of the occupant; a water detector configured to be attached to the occupant and configured to detect water; and a fall-into-water accident determinator configured to determine whether a fall-into-water accident in which the occupant falls into water from the vessel occurs. The fall-into-water accident determinator determines whether the weight changes based on a detection result of the weight detector. The fall-into-water accident determinator determines whether the occupant is immersed in water based on a detection result of the water detector. And the fall-into-water accident determinator determines that the fall-into-water accident occurs when the weight changes and the occupant is immersed in water.

In order to solve the above-described problem, the fall-into-water accident determination method of the present invention includes a weight determination step of determining whether weight applied to a foot of an occupant of a vessel changes based on a detection result of a weight detector configured to be attached to the occupant of the vessel and configured to detect the weight; and an immersion determination step of determining whether the occupant is immersed in water based on a detection result of a water detector configured to be attached to the occupant and configured to detect water. When it is determined that the weight changes in the weight determination step and it is determined that the occupant is immersed in water in the immersion determination step, it is determined that a fall-into-water accident in which the occupant falls into water from the vessel occurs.

BRIEF DESCRIPTION OF DRAWINGS

FIG. 5 is an illustrative diagram showing a shore, a harbor, an offing, vessels, or the like.

DESCRIPTION OF EMBODIMENTS

Figure 1:
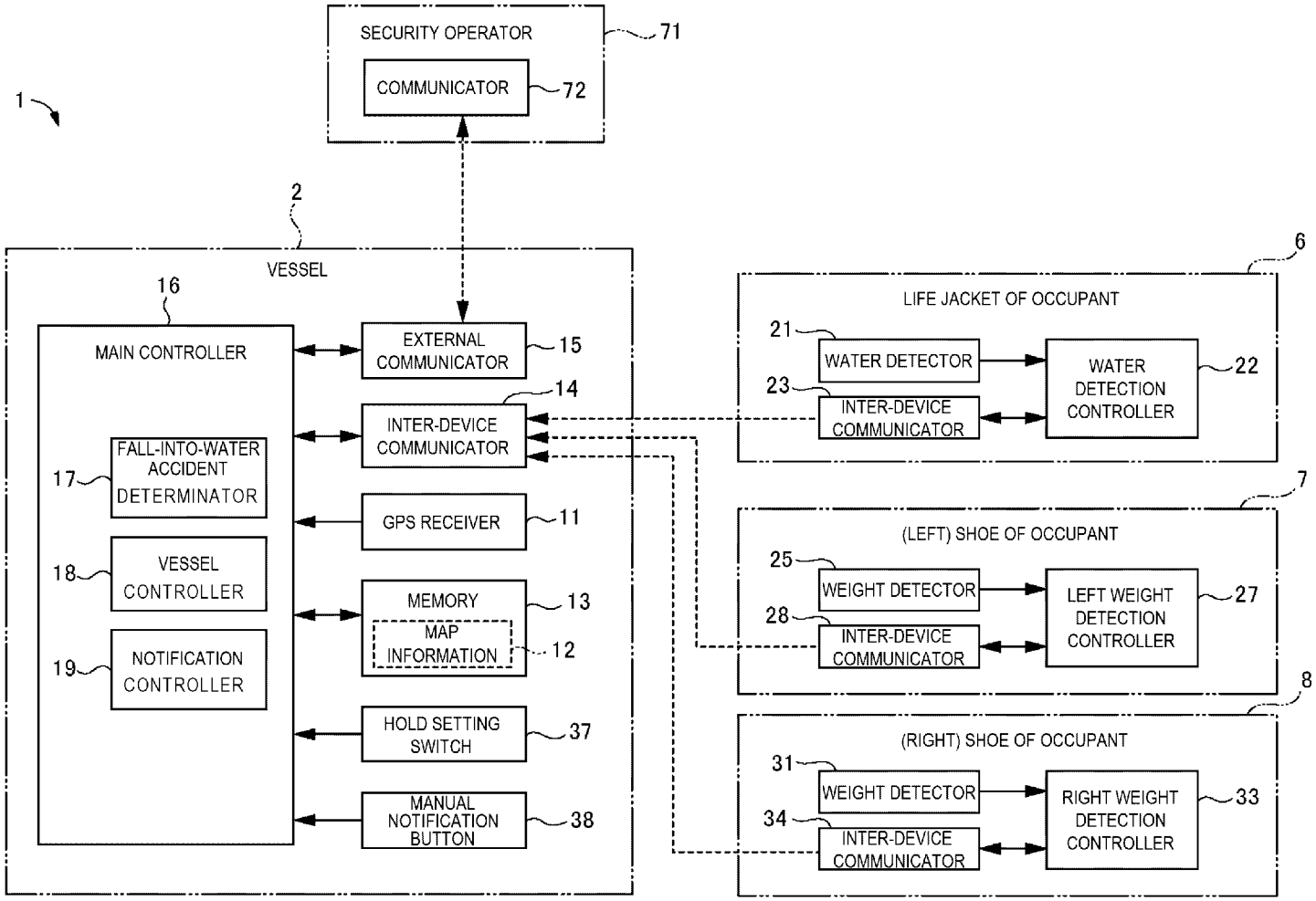
FIG. 1 is a block diagram showing a fall-into-water accident determination system according to a first embodiment of the present invention.

A fall-into-water accident determination system according to an embodiment of the present invention includes a weight detector that detects weight applied to foot of an occupant on a vessel, a water detector that detects water, and a fall-into-water accident determinator that determines whether a fall-into-water accident in which the occupant falls into water from the vessel occurs. Further, the weight detector and the water detector are attached to the occupant.

The fall-into-water accident determinator determines whether the weight applied to the foot of the occupant changes based on a detection result acquired by the weight detector, and determines whether the occupant is immersed in water based on the detection result acquired by the water detector. Then, the fall-into-water accident determinator determines that the fall-into-water accident occurs when the weight applied to the foot of the occupant changes and the occupant is immersed in water.

According to the fall-into-water accident determination system according to the embodiment of the present invention having such a configuration, it is possible to accurately determine the occurrence of a fall-into-water accident. Hereinafter, the present invention will be described in detail.

When the occupant is on the vessel, the foot of the occupant is in contact with the floor surface of the vessel. When the occupant stands on the floor surface, the entire weight of the occupant is applied to the feet of the occupant, and when the occupant sits on a chair or the like, a part of the weight of the occupant is applied to the feet of the occupant. On the other hand, if the movement of the occupant when the occupant falls into water from the vessel is analyzed, first, the feet of the occupant are separated the floor surface of the vessel and float in the air, and then the feet and other parts of the occupant enter the water. Therefore, when the occupant falls into water from the vessel, the weight applied to the foot of the occupant changes. Further, when the occupant tumbles on the floor surface of the vessel, most of the weight of the occupant is not applied to the foot of the occupant, and thus the weight applied to the foot of the occupant changes even when the occupant tumbles on the floor surface of the vessel. In this way, when the occupant falls into water from the vessel or when the occupant tumbles on the floor surface of the vessel, the weight applied to the foot of the occupant changes.

On the other hand, when the occupant falls into water from the vessel or when the occupant is exposed to a large amount of water while being on the vessel, the occupant is in a state of being immersed in water.

From the above, the following can be seen. When the occupant falls into water from the vessel, the weight applied to the foot of the occupant changes, and the occupant is in the state of being immersed in water. On the other hand, when the occupant tumbles on the floor surface of the vessel, although the weight applied to the foot of the occupant changes, the occupant is not in the state of being immersed in water. Further, when the occupant is exposed to a large amount of water while being on the vessel, the occupant is in a state of being immersed in the water, but the weight applied to the foot of the occupant does not substantially change. Therefore, when both a condition that the weight applied to the foot of the occupant changes and a condition that the occupant is immersed in water are satisfied, it is possible to accurately determine that the occupant falls into water from the vessel.

Based on the above consideration, the fall-into-water accident determinator determines the fall-into-water accident occurs when the weight applied to the foot of the occupant changes and the occupant is immersed in water based on the detection results acquired by the weight detector and the water detector. According to the fall-into-water accident determination system according to the embodiment of the present invention, it is possible to accurately determine the occurrence of the fall-into-water accident.

Further, the fall-into-water accident determination method of the present invention includes a weight determination step of determining whether weight applied to a foot of an occupant of a vessel changes based on a detection result of a weight detector configured to be attached to the occupant of the vessel and configured to detect the weight; and an immersion determination step of determining whether the occupant is immersed in water based on a detection result of a water detector configured to be attached to the occupant and configured to detect water. When it is determined that the weight changes in the weight determination step and it is determined that the occupant is immersed in water in the immersion determination step, it is determined that a fall-into-water accident in which the occupant falls into water from the vessel occurs. According to the fall-into-water accident determination method according to the embodiment of the present invention, similarly to the fall-into-water accident determination system, it is possible to accurately determine the occurrence of the fall-into-water accident.

First Embodiment

Hereinafter, several embodiments of the fall-into-water accident determination system in the present invention will be described. The fall-into-water accident determination system according to each embodiment of the present invention has a function of recognizing the occurrence of a fall-into-water accident in which an occupant of a vessel falls into water from the vessel, and a function of automatically transmitting a fall-into-water accident notification that reports the occurrence of the fall-into-water accident. Specifically, the fall-into-water accident determination system according to each embodiment of the present invention recognizes that the weight applied to the bottom surface of the foot of the occupant changes and the occupant is immersed in water while the vessel is leaving a shore, and determines whether the fall-into-water accident occurs based on the recognition. The fall-into-water accident determination system according to each embodiment of the present invention recognizes a state of a fall-into-water place, when the fall-into-water place is not in the gentle state, the fall-into-water accident determination system immediately transmits the fall-into-water accident notification. And when the fall-into-water place is in the gentle state, the fall-into-water accident determination system suspends the transmission of the fall-into-water accident notification for a predetermined time. In addition, the fall-into-water accident determination system according to each embodiment of the present invention cancels the transmission of the fall-into-water accident notification when the occupant who has fallen into water returns to the vessel while the transmission of the fall-into-water accident notification is suspended.

It does not matter whether the fall-into-water place is a sea, a lake, or a river. The type and size of the vessel are also not limited. However, the fall-into-water accident determination system according to each embodiment of the present invention can be suitably applied to a small vessel that holds a maximum of one or several persons and that is equipped with a motor. In each of the following embodiments, a case in which the fall-into-water accident determination system of the present invention is applied to the small vessel for fishing, is described.

Configuration of Fall-into-Water Accident Determination System

Figure 2:
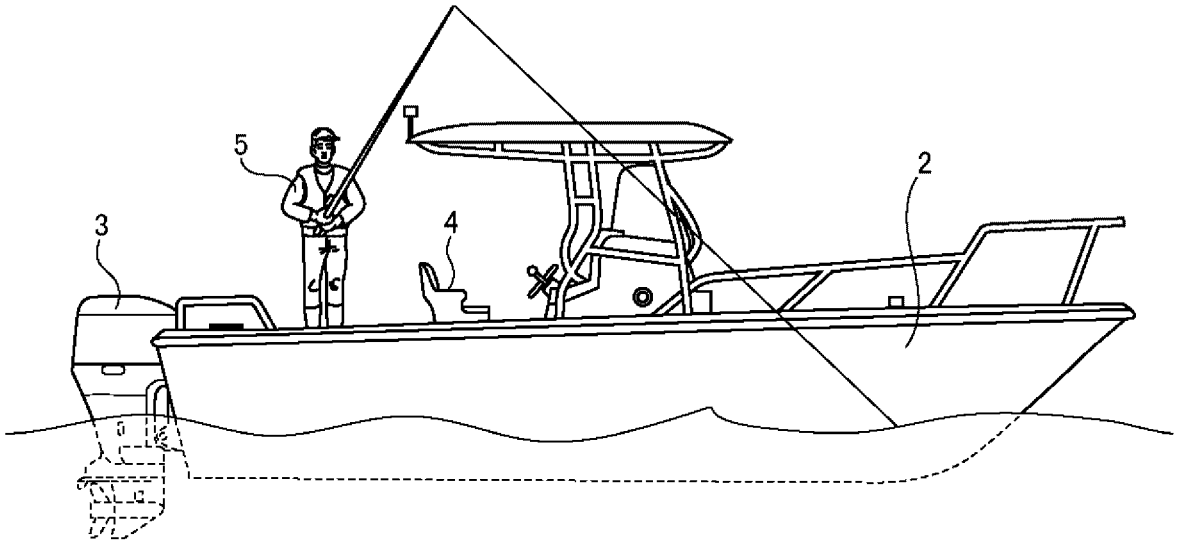
FIG. 2 is an illustrative diagram showing a vessel and an occupant to which the fall-into-water accident determination system according to the first embodiment of the present invention is applied.
Figure 3:
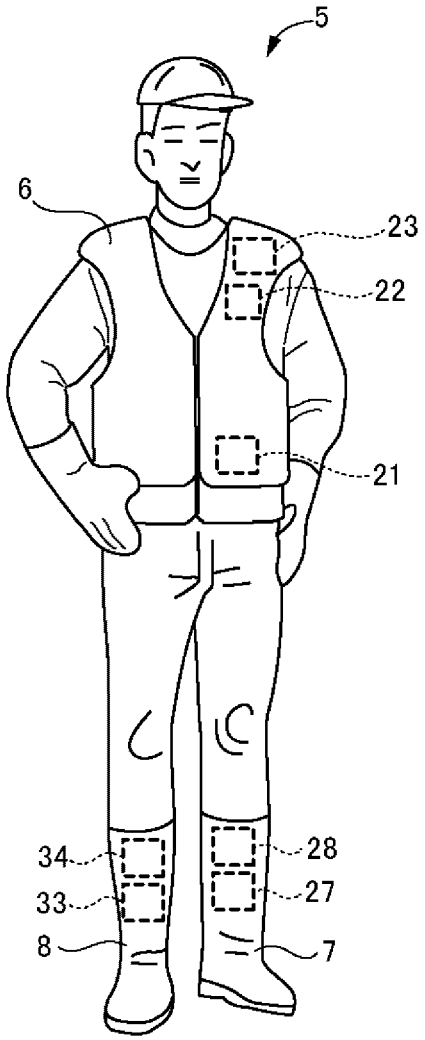
FIG. 3 is an illustrative diagram showing an arrangement of a water detector, a water detection controller, a weight detection controller, or the like in the fall-into-water accident determination system according to the first embodiment of the present invention.
Figure 4:
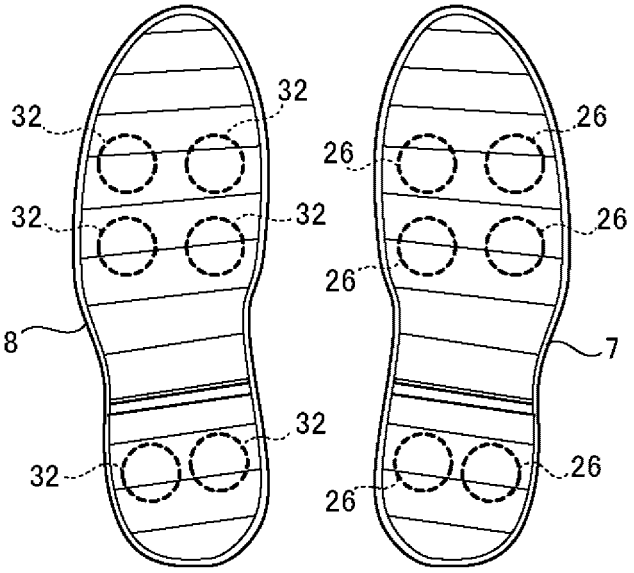
FIG. 4 is an illustrative diagram showing an arrangement of weight detectors in the fall-into-water accident determination system according to the first embodiment of the present invention.

FIG. 1 shows a fall-into-water accident determination system 1 according to a first embodiment of the present invention. FIG. 2 shows a vessel 2 and an occupant 5 of the vessel 2 to which the fall-into-water accident determination system 1 is applied. FIG. 3 shows the occupant 5 wearing a life jacket 6 and left and right shoes 7, 8. FIG. 4 shows the left and right shoes 7, 8 as viewed from bottom sides thereof.

As shown in FIG. 1, components of the fall-into-water accident determination system 1 are dispersed in the vessel 2, the life jacket 6 worn by the occupant 5, and the left and right shoes 7, 8 worn by the occupant 5. That is, the fall-into-water accident determination system 1 includes a global positioning system (GPS) receiver 11, a memory 13 in which map information 12 is stored, an inter-device communicator 14, an external communicator 15, and a main controller 16, which are provided in the vessel 2. The fall-into-water accident determination system 1 further includes a water detector 21, a water detection controller 22, and an inter-device communicator 23, which are attached to the life jacket 6 worn by the occupant 5. The fall-into-water accident determination system 1 further includes a weight detector 25, a left weight detection controller 27, and an inter-device communicator 28, which are attached to the left shoe 7 worn by the occupant 5. The fall-into-water accident determination system 1 further includes a weight detector 31, a right weight detection controller 33, and an inter-device communicator 34, which are attached to the right shoe 8 worn by the occupant 5. Dashed arrows in FIG. 1 indicate wireless signal paths.

The GPS receiver 11 is a device that receives a signal used for position detection of the vessel 2 from a GPS satellite. The memory 13 is, for example, a device including a semiconductor memory element. The memory 13 stores map information 12 used for position detection of the vessel 2. The memory 13 is also used for storing information other than the map information 12. For example, the memory 13 stores information indicating the weight of the occupant 5 or the like.

The inter-device communicator 14 is a device that performs wireless communication with the inter-device communicator 23 attached to the life jacket 6, the inter-device communicator 28 attached to the left shoe 7, and the inter-device communicator 34 attached to the right shoe 8, respectively. The inter-device communicator 14 receives a water detection signal transmitted from the inter-device communicator 23, a weight detection signal transmitted from the inter-device communicator 28, and a weight detection signal transmitted from the inter-device communicator 34 respectively, and outputs these signals to the main controller 16. The inter-device communicator 14 includes a communication circuit for performing such communication. The inter-device communicator 14 may be incorporated in the main controller 16.

The external communicator 15 is a device that communicates with a communicator 72 of a security operator 71. The external communicator 15 is, for example, a wireless device such as a fishery wireless device. The security operator 71 is, for example, the Fishery Cooperative or the Maritime Safety Agency, or the like. The communicator 72 of the security operator 71 is capable of performing wireless communication with the external communicator 15. The external communicator 15 receives environmental information transmitted from the communicator 72. The environmental information is includes at least meteorologic information or hydrographic information of a place where the vessel 2 is located. In the present embodiment, the environmental information includes, for example, information such as weather, wind direction, wind speed, a field of view, presence and absence of undulation, a state of water flow, and wave height of a place where the vessel 2 is located. The external communicator 15 transmits the fall-into-water accident notification to the communicator 72.

The external communicator 15 may communicate with a communicator other than the communicator 72. For example, the external communicator 15 may communicate with a communicator of a service provider who specializes in providing meteorologic and hydrographic information, and may receive detailed meteorologic and hydrographic information as the environmental information from the service provider. Further, the external communicator 15 may communicate with a communicator in a call center, a home of the occupant 5, a company of the occupant 5 or the like, and may transmit the fall-into-water accident notification to the call center, the home of the occupant 5, the company of the occupant 5, or the like.

The main controller 16 is, for example, a microcontroller, and includes a central processing unit (CPU), a read only memory (ROM), a random access memory (RAM), or the like. The main controller 16 reads and executes a computer program stored in, for example, the ROM, thereby functioning as a fall-into-water accident determinator 17, a vessel controller 18, and a notification controller 19. The fall-into-water accident determination system 17 recognizes that the weight applied to bottom surfaces of feet of the occupant 5 changes and the occupant 5 is immersed in water while the vessel 2 is leaving the shore, and determines whether the fall-into-water accident occurs based on the recognition. When the fall-into-water accident determinator 17 determines that the fall-into-water accident occurs, the vessel controller 18 stops the motor 3 (see FIG. 2) which is a power source of the vessel 2. The notification controller 19 controls the external communicator 15 and causes the external communicator 15 to transmit the fall-into-water accident notification.

The water detector 21 attached to the life jacket 6 is a device that detects water. The water detector 21 is provided to determine whether the occupant 5 is immersed in water due to falling into water. The water detector 21 is, for example, a water battery. A water battery is a known device that generates power when placed in water. In the present embodiment, the water battery is connected to the water detection controller 22, and a current during power generation of the water battery is input to the water detection controller 22.

The water detection controller 22 is, for example, a microprocessor, and outputs a water detection signal to the inter-device communicator 23 when the current during power generation of the water battery is input. For example, the water detection signal is an electric signal whose voltage becomes a high level when the water detector 21 detects water, and whose voltage becomes a low level when the water detector 21 does not detect water. Instead of the microprocessor, the water detection controller 22 may be configured with a simple electric circuit such as a transistor circuit that generates the water detection signal having a predetermined voltage when the current during power generation of the water battery is input.

The inter-device communicator 23 is a device that performs wireless communication with the inter-device communicator 14 installed in the vessel 2. The inter-device communicator 23 transmits the water detection signal output from the water detection controller 22 to the inter-device communicator 14. When the water detection controller 22 is a microprocessor, the inter-device communicator 23 may be incorporated in the water detection controller 22.

As shown in FIG. 3, the water detector 21, the water detection controller 22, and the inter-device communicator 23 are attached to the life jacket 6 worn by the occupant 5. The water detector 21 is disposed at a part of the life jacket 6 that is reliably immersed in water when the occupant 5 falls into water. For example, the water detector 21 is disposed at a lower part of the life jacket 6. By disposing the water detector 21 at a part reliably immersed in water when the occupant 5 falls into water, water can be reliably detected when the occupant 5 falls into water. The inter-device communicator 23 is disposed at a part of the life jacket 6 that is likely to come out of the water surface when the occupant 5 falls into water. Since the inter-device communicator 23 is disposed at a part that is likely to come out of the water surface when the occupant 5 falls into water, it is possible to prevent radio waves emitted from the inter-device communicator 23 to the inter-device communicator 14 from being weakened by the interposition of water when the occupant 5 falls into water.

The weight detector 25 attached to the left shoe 7 is a device that detects a weight applied to a bottom surface of a left foot of the occupant 5. As shown in FIG. 4, the weight detector 25 includes a plurality of piezoelectric elements 26, and these piezoelectric elements 26 are attached to the sole of the left shoe 7. Of the weight of the occupant 5, the weight applied to the bottom surface of the left foot of the occupant 5 can be detected by these piezoelectric elements 26. The plurality of piezoelectric elements 26 are dispersed in the sole of the left shoe 7. At the sole of the shoe, since a part corresponding to an arch of the foot does not receive much weight of the occupant 5, the plurality of piezoelectric elements 26 are disposed so as to avoid this part. The piezoelectric elements 26 are electrically connected to the left weight detection controller 27. Each piezoelectric element 26 outputs an electric signal having a voltage corresponding to the weight which is applied to the piezoelectric element itself to the left weight detection controller 27.

The left weight detection controller 27 is, for example, a microprocessor, and outputs a weight detection signal indicating the weight applied to the bottom surface of the left foot of the occupant 5 to the inter-device communicator 28 based on the electric signal output from each piezoelectric element 26. The left weight detection controller 27 is disposed, for example, at a part of the left shoe 7 corresponding to the shin of the foot.

The inter-device communicator 28 is a device that performs wireless communication with the inter-device communicator 14 installed in the vessel 2. The inter-device communicator 28 transmits the weight detection signal output from the left weight detection controller 27 to the inter-device communicator 14. The inter-device communicator 28 is disposed together with the left weight detection controller 27, for example, at a part of the left shoe 7 corresponding to the shin of the foot. The inter-device communicator 28 may be incorporated in the left weight detection controller 27.

The weight detector 31 attached to the right shoe 8 is a device that detects a weight applied to a bottom surface of a right foot of the occupant 5. As shown in FIG. 4, the weight detector 31 includes a plurality of piezoelectric elements 32, and these piezoelectric elements 32 are attached to the sole of the right shoe 8. Of the weight of the occupant 5, the weight applied to the bottom surface of the right foot of the occupant 5 can be detected by these piezoelectric elements 32. The arrangement of the plurality of piezoelectric elements 32 is determined so as to be symmetrical to the arrangement of the plurality of piezoelectric elements 26 in the left shoe 7. Each piezoelectric element 32 is electrically connected to the right weight detection controller 33, and outputs an electric signal having a voltage corresponding to the weight which is applied to the piezoelectric element 32 itself to the right weight detection controller 33.

The right weight detection controller 33 outputs a weight detection signal indicating the weight applied to the bottom surface of the right foot of the occupant 5 to the inter-device communicator 34 based on the electric signal output from each piezoelectric element 32. The inter-device communicator 34 transmits the weight detection signal output from the right weight detection controller 33 to the inter-device communicator 14. The right weight detection controller 33 and the inter-device communicator 34 are configured in a similar manner as the left weight detection controller 27 and the inter-device communicator 28, and are disposed, for example, at parts of the right shoe 8 corresponding to the shin of the foot. The inter-device communicator 34 may be incorporated in the right weight detection controller 33.

The life jacket 6 is provided with a battery for supplying power to the water detection controller 22 and the inter-device communicator 23. The left shoe 7 is provided with a battery for supplying power to the left weight detection controller 27 and the inter-device communicator 28. The right shoe 8 is provided with a battery for supplying power to the right weight detection controller 33 and the inter-device communicator 34. Power to the GPS receiver 11, the memory 13, the inter-device communicator 14, the external communicator 15, and the main controller 16 provided in the vessel 2 is supplied from a power supply device provided in the vessel 2. These batteries and the power supply device are not shown in the drawings.

The water detection controller 22, the inter-device communicator 23, and the battery for supplying power thereto are housed in a case having a waterproof function, and are attached to the life jacket 6. The left weight detection controller 27, the inter-device communicator 28, and the battery for supplying power thereto are also housed in a case having a waterproof function, and are attached to the left shoe 7. Further, the right weight detection controller 33, the inter-device communicator 34, and the battery for supplying power thereto are also housed in a case having a waterproof function, and are attached to the right shoe 8. The weight detector 25 and the weight detector 31 are also provided with waterproof measure.

A hold setting switch 37 serving as a hold setting unit is connected to the main controller 16 provided in the vessel 2. By operating the hold setting switch 37, the occupant 5 can switch whether to hold a fall-into-water accident notification to-be-described below. A manual notification button 38 serving as a manual notifier is connected to the main controller 16. By pressing the manual notification button 38, the occupant can manually and immediately transmit the fall-into-water accident notification. The hold setting switch 37 and the manual notification button 38 are attached to, for example, an operation device of the vessel 2.

Offshore of Vessel

The fall-into-water accident determination system 1 mainly determines the occurrence of a fall-into-water accident while the vessel is leaving the shore. In general, when the occupant 5 falls into water from the vessel 2 when the vessel 2 is docked at the shore, in many cases, the fall of the occupant 5 is found by other persons on the shore, and the occupant 5 who has fallen into water is likely to be quickly rescued based on the notification from the persons. On the other hand, when the occupant 5 falls into water from the vessel 2 when the vessel 2 leaves the shore and the vessel 2 is, for example, in an offing, since it is hard for other persons to find the falling of the occupant 5, the detection, notification, and rescue of the occupant 5 who has fallen into water may be delayed. In particular, in a case where the occupant 5 is on the vessel 2 alone and falls into water in the offing, the fall of the occupant 5 may not be found and the whereabouts of the occupant 5 may not be known. Therefore, when the occupant 5 falls into water from the vessel 2 while the vessel 2 is leaving the shore, it is highly necessary to quickly recognize the occurrence of the fall-into-water accident and to automatically make a notification of the fall-into-water accident. Thus, the fall-into-water accident determination system 1 mainly determines the occurrence of the fall-into-water accident while the vessel is leaving the shore. Incidentally, the fall-into-water accident determination system 1 can also be adopted for a fall-into-water accident when the vessel is docked at the shore.

Figure 5:
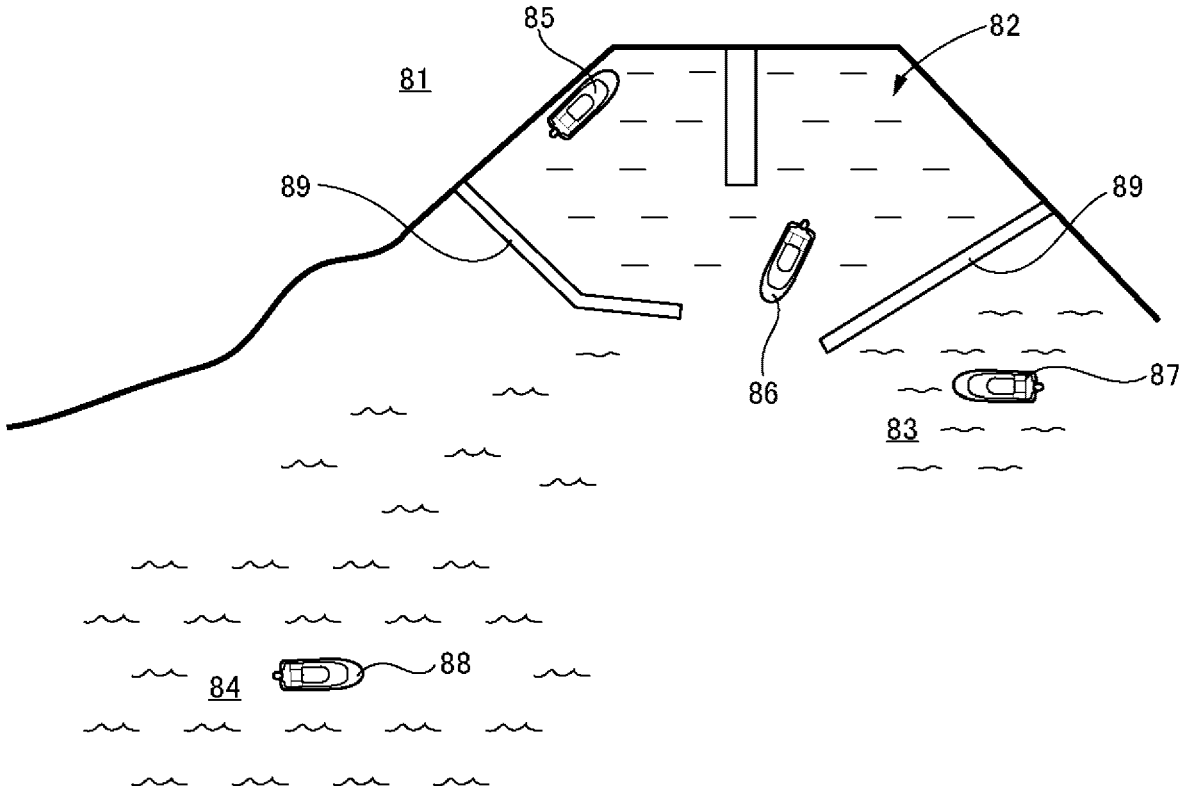

FIG. 5 shows a shore 81, a harbor 82, a coast 83, an offing 84, and vessels 85 to 88 present in the harbor 82, the coast 83, and the offing 84. In FIG. 5, the vessel 85 stops at a position close to a wharf or a quay in the harbor 82 in which wind is suppressed by a breakwater 89. The vessel 85 corresponds to a vessel docked at the shore. On the other hand, the vessel 86 is located in the harbor 82, the vessel 87 is located in the coast 83, and the vessel 88 is located in the offing 84. Although distances between the vessels 86 to 88 and the shore are different, all of the vessels 86 to 88 are far from the wharf or the quay. These vessels 86 to 88 correspond to vessels leaving the shore. Incidentally, although not shown, a vessel located in the ocean also corresponds to a vessel leaving the shore.

Method for Determining Weight Change when Occupant Falls into Water

Further, as described above, in determining the occurrence of the fall-into-water accident, the fall-into-water accident determination system 1 determines whether the weight applied to the bottom surfaces of the feet of the occupant 5 changes. The determination method will be described in detail.

The weight applied to the bottom surfaces of the feet of the occupant 5 means a sum of the weight applied to the bottom surface of the left foot of the occupant 5 and the weight applied to the bottom surface of the right foot of the occupant 5. For example, when the occupant 5 stands on the floor surface of the vessel 2 with both feet, the entire weight of the occupant 5 is distributed to the left foot and the right foot of the occupant 5. When the occupant 5 stands on the floor surface of the vessel 2 only with the left foot, the entire weight of the occupant 5 is applied to the left foot of the occupant 5. When the occupant 5 stands on the floor surface of the vessel 2 only with the right foot, the entire weight of the occupant 5 is applied to the right foot of the occupant 5. As described above, since the weight applied to the bottom surfaces of the feet of the occupant 5 is the sum of the weight applied to the bottom surface of the left foot of the occupant 5 and the weight applied to the bottom surface of the right foot of the occupant 5, the weight applied to the bottom surfaces of the feet of the occupant 5 is the same value in the cases where the occupant 5 stands on the floor surface of the vessel 2 with both feet, only with the right foot, or only with the left foot. The fall-into-water accident determination system 1 recognizes the weight applied to the bottom surface of the left foot of the occupant 5 based on the weight detection signal transmitted from the inter-device communicator 28 attached to the left shoe 7. Further, the fall-into-water accident determination system 1 recognizes the weight applied to the bottom surface of the right foot of the occupant 5 based on the weight detection signal transmitted from the inter-device communicator 34 attached to the right shoe 8. And the fall-into-water accident determination system 1 obtains the weight applied to the bottom surfaces of the feet of the occupant 5 by summing the weight applied to the bottom surface of the left foot of the occupant 5 and the weight applied to the bottom surface of the right foot of the occupant 5.

The weight applied to the bottom surfaces of the feet of the occupant 5 varies depending on the posture of the occupant 5. That is, when the occupant 5 stands on the floor surface of the vessel 2 with both feet, the entire weight of the occupant 5 is distributed to the left foot and the right foot of the occupant 5. Therefore, when the occupant 5 stands on the floor surface of the vessel 2 with both feet before falling into water, the weight applied to the bottom surfaces of the feet of the occupant 5 is substantially equal to the weight of the occupant 5. In this case, the factor that the weight applied to the bottom surfaces of the feet of the occupant 5 does not completely match the weight of the occupant 5 is that, for example, the weight applied to the bottom surfaces of the feet of the occupant 5 changes by about 1 to 2 kg depending on whether the occupant 5 holds a fishing rod.

When the occupant 5 sits on, for example, a chair 4 (see FIG. 2) or the like provided on the vessel 2 with both feet or one foot on the floor surface of the vessel 2, a part of the weight of the occupant 5 is applied to the bottom surfaces of both feet of the occupant 5 or the bottom surface of a left or right foot which is on the floor surface. Therefore, before falling into water, the weight applied to the bottom surfaces of the feet of the occupant 5 when the occupant 5 sits on the chair 4 or the like with both feet or one foot on the floor surface of the vessel 2 is smaller than the weight applied to the bottom surfaces of the feet of the occupant 5 when the occupant 5 stands on the floor surface of the vessel 2 with both feet.

Further, (i) when the occupant 5 sits on the chair 4 or the like with the bottom surfaces of both feet separated from the floor surface of the vessel 2, (ii) when the occupant 5 tumbles on the floor surface of the vessel 2, and (iii) at the moment when the occupant 5 falls into water from the vessel 2, the weight applied to the bottom surfaces of the feet of occupant 5 is smaller than the weight applied to the bottom surfaces of the feet of the occupant 5 when the occupant 5 sits on the chair 4 or the like with both feet or one foot on the floor surface, and specifically, the weight is approximately 0 kg. The following can be considered as reasons why the weight applied to the bottom surfaces of the feet of the occupant 5 does not completely match 0 kg in these cases. That is, when the shoes 7, 8 are worn on the feet, the bottom surfaces of the feet and the soles of the shoes 7, 8 are pressed against each other, and pressure may be generated therebetween. Even when the bottom surfaces of the feet of the occupant 5 are completely separated from the floor surface of the vessel 2, this pressure is detected by the weight sensors 25, 31, so that the weight applied to the bottom surfaces of the feet of the occupant 5 may not completely match 0 kg.

That is, when the occupant 5 sits on the chair 4 or the like with the bottom surfaces of both feet separated from the floor surface of the vessel 2, for example, when the occupant 5 sits on the chair 4 or the like with heels of both feet on an object placed on the floor surface of the vessel 2, the bottom surfaces of both feet are separated from the floor surface of the vessel 2. In this case, since the weight of the occupant 5 is hardly applied to the bottom surface of each foot of the occupant 5, the weight applied to the bottom surfaces of the feet of the occupant 5 is approximately 0 kg. When the occupant 5 tumbles on the floor surface of the vessel 2, the bottom surfaces of both feet of the occupant 5 are separated from the floor surface of the vessel 2. At this time, since the weight of the occupant 5 is hardly applied to the bottom surface of each foot of the occupant 5, the weight applied to the bottom surfaces of the feet of the occupant 5 is approximately 0 kg. When the occupant 5 falls into water from the vessel 2, first, the occupant 5 falls from the vessel 2 toward the water surface, and then all or a part of the body of the occupant 5 is immersed in water. Therefore, since the bottom surface of each foot of the occupant 5 is separated from the floor surface of the vessel 2 at the moment when the occupant 5 falls into water from the vessel 2, the weight of the occupant 5 is hardly applied to the bottom surface of each foot of the occupant 5. Therefore, the weight applied to the bottom surfaces of the feet of the occupant 5 is approximately 0 kg at the moment when the occupant 5 falls into water from the vessel 2.

From the above study, the following can be seen. That is, when the occupant 5 stands on the floor surface of the vessel 2 with both feet before falling into water, the weight applied to the bottom surfaces of the feet of the occupant 5 is referred to as w1. Further, when the occupant 5 sits on the chair 4 or the like with both feet or one foot on the floor surface of the vessel 2 before falling into water, the weight applied to the bottom surfaces of the feet of the occupant 5 is referred to as w2. Further, (i) when the occupant 5 sits on the chair 4 or the like with the bottom surfaces of both feet separated from the floor surface of the vessel 2, (ii) when the occupant 5 tumbles on the floor surface of the vessel 2, and (iii) at the moment when the occupant 5 falls into water from the vessel 2, the weight applied to the bottom surfaces of the feet of the occupant 5 is referred to as w3 (approximately 0 kg). In this case, when the weight applied to the bottom surfaces of the feet of the occupant 5 changes from w1 to w3 or from w2 to w3, the occupant 5 (i) sits on the chair 4 or the like with the bottom surfaces of both feet separated from the floor surface of the vessel 2, (ii) tumbles on the floor surface of the vessel 2, or (iii) falls into water from the vessel 2.

Based on such a concept, in the fall-into-water accident determination system 1, a value close to w3 (for example, several kg) is set as a first weight reference value K1, and the first weight reference value K1 is stored in the memory 13 or the like. Then, in determining the occurrence of the fall-into-water accident, the fall-into-water accident determination system 1 determines whether the weight applied to the bottom surfaces of the feet of the occupant 5 changes from a value greater than the first weight reference value K1 to a value equal to or less than the first weight reference value K1. And when the weight applied to the bottom surfaces of the feet of the occupant 5 changes in this way, the fall-into-water accident determination system 1 determines that the occupant 5 is in one of the states (i) where the occupant 5 sits on the chair 4 or the like with the bottom surfaces of both feet separated from the floor surface of the vessel 2, (ii) where the occupant 5 tumbles on the floor surface of the vessel 2, and (iii) where the occupant 5 falls into water from the vessel 2.

As an example, the weight of the occupant 5 (including a wearing article of the occupant 5) is 70 kg, and the weight applied to both feet when the person sits on the chair is 16% of the weight of the person. Further, when the occupant 5 stands on the floor surface of the vessel 2 with both feet before falling into water, the weight w1 applied to the bottom surfaces of the feet of the occupant 5 is the same as the weight of the occupant 5. In this case, w1 is 70 kg, and w2 is 11.2 kg. The first weight reference value K1 is set as 5 kg. In the above case, when both feet of the occupant 5 are separated from the floor surface of the vessel 2 after the occupant 5 sits on the chair 4 of the vessel 2 with both feet on the floor surface of the vessel 2, the weight applied to the bottom surfaces of the feet of the occupant 5 changes from 11.2 kg to approximately 0 kg. When the occupant 5 tumbles on the floor surface of the vessel 2 from the standing state with both feet, the weight applied to the bottom surfaces of the feet of the occupant 5 changes from 70 kg to approximately 0 kg. When the occupant 5 falls into water from the standing state with both feet on the floor surface of the vessel 2, the weight applied to the bottom surfaces of the feet of the occupant 5 changes from 70 kg to approximately 0 kg. In any of these three cases, the weight applied to the bottom surfaces of the feet of the occupant 5 changes from a value greater than 5 kg to a value of equal to or less than 5 kg, that is, from a value greater than the first weight reference value K1 to a value equal to or less than the first weight reference value K1. When the weight applied to the bottom surfaces of the feet of the occupant 5 changes from the value greater than the first weight reference value K1 to the value equal to or less than the first weight reference value K1, the fall-into-water accident determination system 1 determines that the occupant 5 is in one of the states (i) where the occupant 5 sits on the chair 4 or the like with the bottom surfaces of both feet separated from the floor surface of the vessel 2, (ii) where the occupant 5 tumbles on the floor surface of the vessel 2, and (iii) where the occupant 5 falls into water from the vessel 2. As will be described later, the fall-into-water accident determination system 1 determines that the fall-into-water accident occurs when both the condition that the weight applied to the bottom surfaces of the feet of the occupant 5 changes from the value greater than the first weight reference value K1 to the value equal to or less than the first weight reference value K1 and the condition that the occupant 5 is immersed in water are satisfied.

Method for Determining Weight Change after Occupant Falls into Water

Further, after recognizing the occurrence of the fall-into-water accident, if the fall-into-water place is in the gentle state, the fall-into-water accident determination system 1 determines whether the occupant 5 who has fallen into water has returned to the vessel 2 based on the weight applied to the bottom surfaces of the feet of the occupant 5. The determination method will be described in detail.

Figure 6A:
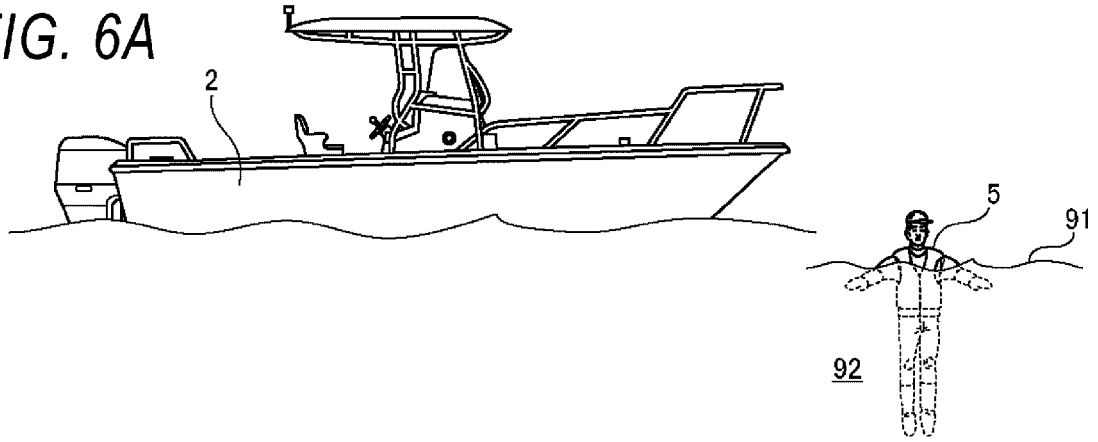
FIGS. 6A to 6C are an illustrative diagrams showing a state of the occupant who has fallen into water.
Figure 6B:
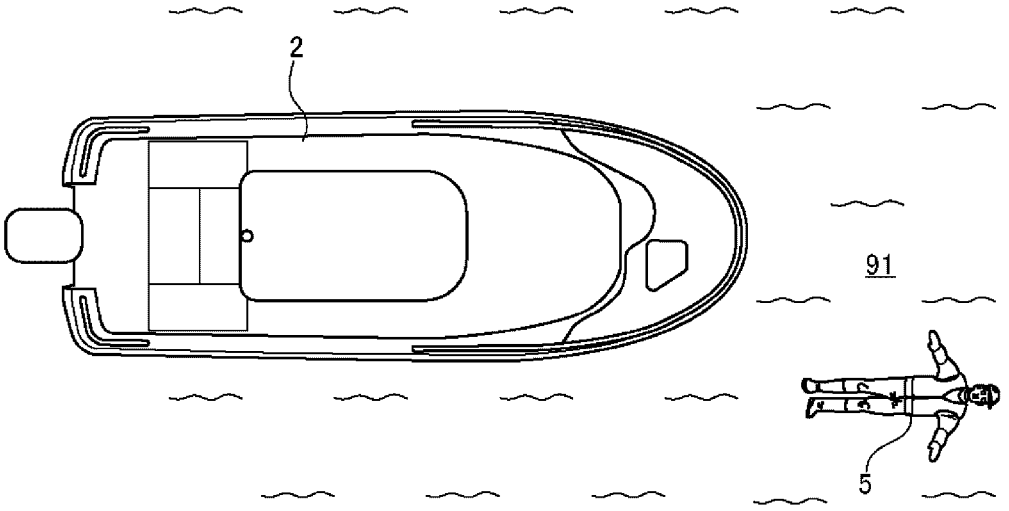
Figure 6C:
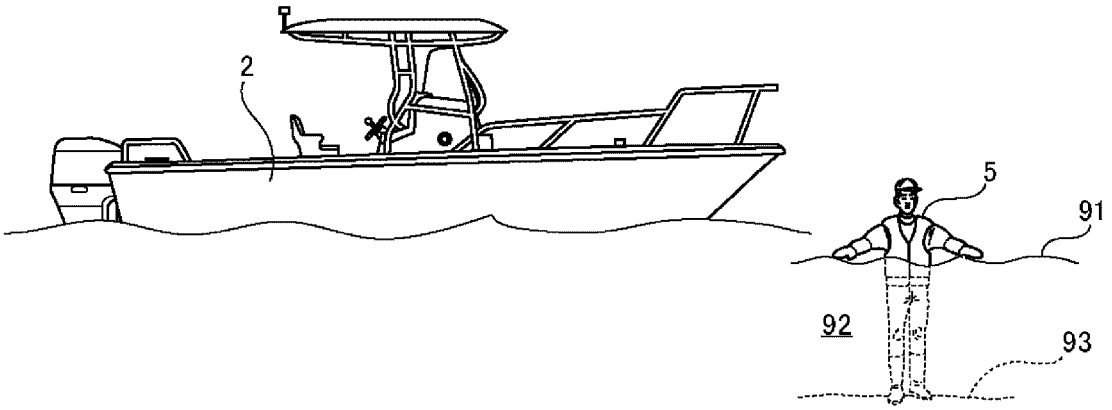

Here, FIG. 6A shows a state in which the occupant 5 falls into a place where the water is deep. In FIG. 6A, a part above the chest of the occupant 5 is out of the water surface 91 by the buoyancy of the occupant 5 and the life jacket 6, and the chest and a part below the chest are submerged in underwater 92. Since the water is deep, the feet of the occupant 5 do not reach the ground of the underwater 92 at all. FIG. 6B shows a state in which the occupant 5 who has fallen into water floats on the water surface 91 in a supine position by the buoyancy of the occupant 5 and the life jacket 6. FIG. 6C shows a state in which the occupant 5 has fallen into a place where the water is shallow. In FIG. 6C, the occupant 5 stands on a ground 93 of the underwater 92, the chest and the part above the chest are out of the water surface 91.

In the state shown in FIG. 6A, both feet of the occupant 5 are separated from the ground. Therefore, in this state, when the occupant 5 does not move both feet in the underwater 92, the weight applied to the bottom surfaces of the feet of the occupant 5 is approximately 0 kg.

Further, in the state shown in FIG. 6A, when the occupant 5 treads water or the like by moving both feet in the underwater 92, a state where water pressure is applied to the bottom surface of each foot of the occupant 5 and a state where no water pressure is applied are repeated. In this case, when no water pressure is applied to the bottom surface of each foot of the occupant 5, the weight applied to the bottom surfaces of the feet of the occupant 5 is approximately 0 kg. On the other hand, when water pressure is applied to the bottom surface of each foot of the occupant 5, the weight applied to the bottom surfaces of the feet of the occupant 5 is substantially equal to the value of the water pressure. The value of the water pressure is much smaller than the weight of the occupant 5.

Further, in the state shown in FIG. 6B, since both feet of the occupant 5 are separated from the ground, the weight applied to the bottom surfaces of the feet of the occupant 5 is approximately 0 kg.

In the state shown in FIG. 6C, both feet of the occupant 5 reach the ground 93, and the weight of the occupant 5 is applied to the bottom surfaces of both feet. However, since a part of the body of the occupant 5 and a part of the life jacket 6 are submerged in the underwater 92, the weight applied to the bottom surfaces of the feet of the occupant 5 is smaller than the weight of the occupant 5 by the buoyancy.

On the other hand, when the occupant 5 who has fallen into water returns to the vessel 2 from the water surface, clothes or the like worn by the occupant 5 are wet and are in a state of absorbing water. Therefore, when the occupant 5 returning from the water surface to the vessel 2 stands on the floor surface of the vessel 2 with both feet, the weight applied to the bottom surfaces of the feet of the occupant 5 is substantially equal to the sum of the weight of the occupant 5 and the weight of water contained in the clothes or the like worn by the occupant 5, which is a value larger than the weight of the occupant 5.

From the above study, the following can be seen. That is, when the occupant 5 who has fallen into water is in the underwater, the weight applied to the bottom surfaces of the feet of the occupant 5 is smaller than the weight of the occupant 5. On the other hand, when the occupant 5 who has fallen into water returns to the vessel 2 and stands on the floor surface of the vessel 2 with both feet, the weight applied to the bottom surfaces of the feet of the occupant 5 is equal to or greater than the weight of the occupant 5.

Based on such a concept, in the fall-into-water accident determination system 1, the weight of the occupant 5 is set as a second weight reference value K2, and the second weight reference value K2 is stored in the memory 13 or the like. Then, the fall-into-water accident determination system 1 determines whether the weight applied to the bottom surfaces of the feet of the occupant 5 becomes a value equal to or greater than the second weight reference value K2 while holding the fall-into-water accident notification after the occurrence of the fall-into-water accident is recognized. By this determination, it is possible to recognize that the occupant 5 who has fallen into water returns to the vessel 2 and stands on the floor surface of the vessel 2.

For example, the weight of the occupant 5 (including the wearing article of the occupant 5) is 70 kg. In this case, the second weight reference value K2 is set to 70 kg. When the occupant 5 returns to the vessel 2 from the water surface and stands on the floor surface of the vessel 2 with both feet after falling into water while the fall-into-water accident notification is held, since the weight applied to the bottom surfaces of the feet of the occupant 5 is a sum of the weight of the occupant 5 and the weight of water contained in the clothes and the like worn by the occupant 5, the weight is greater than 70 kg. At this time, since the weight applied to the bottom surfaces of the feet of the occupant 5 is 70 kg or more, that is, equal to or larger than the second weight reference value K2, the fall-into-water accident determination system 1 determines that the occupant 5 who has fallen into water returns to the vessel 2 and stands on the floor surface of the vessel 2. As will be described later, when it is determined that the occupant 5 who has fallen into water returns to the vessel 2 and stands on the floor surface of the vessel 2 after the occurrence of the fall-into-water accident is recognized and before the hold set time elapses, the fall-into-water accident determination system 1 cancels the fall-into-water accident notification.

Fall-into-Water Accident Determination Method

Figure 7:
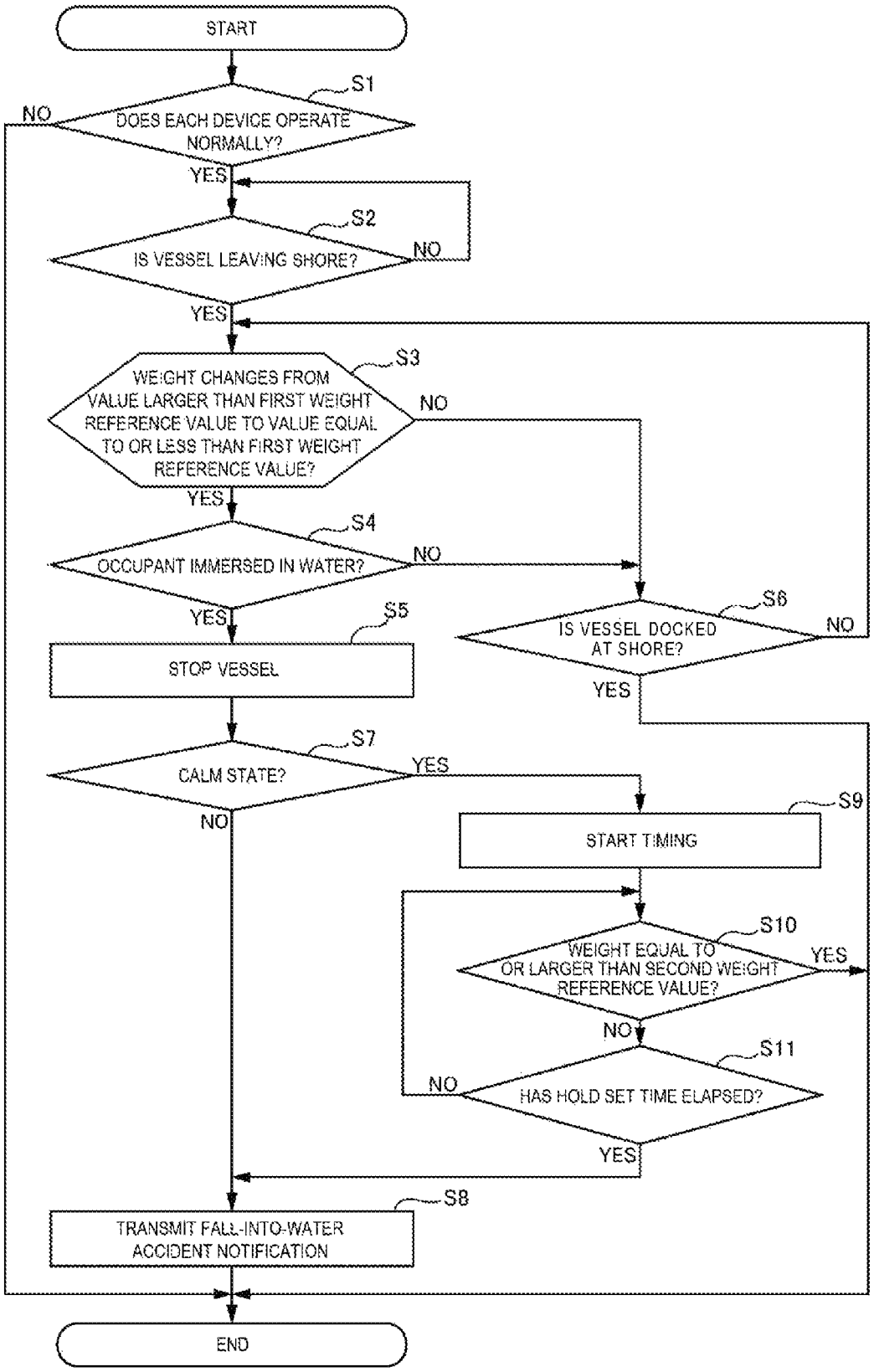
FIG. 7 is a flowchart showing a fall-into-water accident determination process in the fall-into-water accident determination system according to the first embodiment of the present invention.

FIG. 7 shows a fall-into-water accident determination process in the fall-into-water accident determination system 1. For example, when the occupant 5 of the vessel 2 starts the operation of the fall-into-water accident determination system 1, the fall-into-water accident determination process shown in FIG. 7 is started. In the fall-into-water accident determination process, first, the main controller 16 of the fall-into-water accident determination system 1 determines whether each device of the fall-into-water accident determination system 1 operates normally (step S1). For example, the main controller 16 determines whether the power of the water detector 21, the water detection controller 22 and the inter-device communicator 23 attached to the life jacket 6, the weight detector 25, the left weight detection controller 27 and the inter-device communicator 28 attached to the left shoe 7, and the weight detector 31, the right weight detection controller 33, and the inter-device communicator 34 attached to the right shoe 8 is on, whether the battery that supplies power to these devices has a sufficient life, whether communication between the inter-device communicators 23, 28, 34 and the inter-device communicator 14 can be performed normally, or the like.

If each device of the fall-into-water accident determination system 1 does not operate normally (step S1: NO), the main controller 16 outputs, for example, a message requesting confirmation of power-on of the device, a message requesting replacement of a battery, or the like to a display device attached near the operation device of the vessel 2, and the fall-into-water accident determination process is ended.

On the other hand, when each device of the fall-into-water accident determination system 1 operates normally (step S1: YES), the fall-into-water accident determinator 17 of the fall-into-water accident determination system 1 determines whether the vessel 2 is leaving the shore (step S2). Specifically, the fall-into-water accident determinator 17 recognizes the position of the vessel 2 based on the signal received by the GPS receiver 11 from a GPS satellite and the map information 12 stored in the memory 13, and determines whether the position of the vessel 2 is away from the shore to the sea, the lake, the river, or the like.

When the vessel is not leaving the shore (step S2: NO), the fall-into-water accident determinator 17 repeats the determination as to whether the vessel 2 is leaving the shore. On the other hand, when the vessel is leaving the shore (step S2: YES), the fall-into-water accident determinator 17 determines whether the weight applied to the bottom surfaces of the feet of the occupant 5 changes from the value greater than the first weight reference value K1 to the value equal to or less than the first weight reference value K1 (step S3). Specifically, based on the weight detection signals transmitted from the inter-device communicator 28 and the inter-device communicator 34, respectively, the fall-into-water accident determinator 17 recognizes the weight applied to the bottom surface of the left foot and the bottom surface of the right foot of the occupant 5, obtains the weight applied to the bottom surfaces of the feet of the occupant 5 by summing up these weight, and stores the value into the memory 13 or the RAM of the main controller 16. The fall-into-water accident determinator 17 repeats the process of obtaining the weight applied to the bottom surfaces of the feet of the occupant 5 and storing the value in a short cycle of about 0.5 seconds to several seconds after it is determined that the vessel 2 is leaving the shore. Then, the fall-into-water accident determinator 17 compares the weight applied to the bottom surfaces of the feet of the occupant 5 that is currently obtained and the weight applied to the bottom surfaces of the feet of the occupant 5 previously obtained. And the fall-into-water accident determinator 17 determines whether the weight applied to the bottom surfaces of the feet of the occupant 5 changes from the value greater than the first weight reference value K1 to the value equal to or less than the first weight reference value K1.

When the weight applied to the bottom surfaces of the feet of the occupant 5 changes from the value greater than the first weight reference value K1 to the value equal to or less than the first weight reference value K1 (step S3: YES), the fall-into-water accident determinator 17 determines whether the occupant 5 is immersed in water (step S4). Specifically, the fall-into-water accident determinator 17 determines whether water is detected by the water detector 21 based on the water detection signal transmitted from the inter-device communicator 23. When water is detected by the water detector 21, the fall-into-water accident determinator 17 determines that the occupant 5 is immersed in water; when water is not detected by the water detector 21, the fall-into-water accident determinator 17 determines that the occupant 5 is not immersed in water.

When the occupant 5 is immersed in water (step S4: YES), the vessel controller 18 of the fall-into-water accident determination system 1, for example, outputs a stop command signal to the motor 3 of the vessel 2 to stop the motor 3 (step S5). That is, when the weight applied to the bottom surfaces of the feet of the occupant 5 changes from the value greater than the first weight reference value K1 to the value equal to or less than the first weight reference value K1, the occupant 5 is in one of the states (i) where the occupant 5 sits on the chair 4 or the like of the vessel 2 with the bottom surfaces of both feet separated from the floor surface of the vessel 2, (ii) where the occupant 5 tumbles on the floor surface of the vessel 2, and (iii) where the occupant 5 falls into water from the vessel 2. In addition, when the occupant 5 is immersed in water, the state of the occupant 5 is narrowed down to a state of falling into water from the vessel 2, and the occurrence of the fall-into-water accident is recognized. In this case, the fall-into-water accident determination system 1 immediately stops the vessel 2. Accordingly, the propeller of the vessel 2 is stopped and the vessel 2 stops on the spot.

On the other hand, when the weight applied to the bottom surfaces of the feet of the occupant 5 does not change from the value greater than the first weight reference value K1 to the value equal to or less than the first weight reference value K1 (step S3: NO), or when the occupant 5 is not immersed in water (step S4: NO), the fall-into-water accident determinator 17 determines whether the vessel 2 is docked at the shore (step S6). When the vessel 2 is not docked at the shore (step S6: NO), the fall-into-water accident determinator 17 returns the process to step S3. On the other hand, when the vessel 2 is docked at the shore (step S6: YES), the fall-into-water accident determinator 17 ends the fall-into-water accident determination process. In this way, the processes of steps S3 and S4 is repeatedly performed while the vessel 2 is leaving the shore until the occurrence of the fall-into-water accident is recognized, and if the vessel 2 is docked at the shore while the occurrence of the fall-into-water accident is not recognized, the fall-into-water accident determination process is ended.

After the occurrence of the fall-into-water accident is recognized and the control for stopping the motor 3 of the vessel 2 is performed in step S5, the notification controller 19 of the fall-into-water accident determination system 1 determines whether to immediately transmit the fall-into-water accident notification based on the environmental information received by the external communicator 15. Specifically, the environmental information includes meteorologic information or hydrographic information of a place where the vessel 2 is located, and the notification controller 19 determines whether the fall-into-water place at the present time is in a gentle state, for example, a calm state based on the meteorologic information or the hydrographic information (step S7). When the fall-into-water place at the present time is not in the gentle state, for example, the calm state (step S7: NO), the notification controller 19 controls the external communicator 15 to cause the external communicator 15 to immediately transmit the fall-into-water accident notification (step S8). The fall-into-water accident notification includes various information related to the fall-into-water accident, such as information for specifying the vessel 2, the occupant 5, the time of falling into water, and the fall-into-water place, respectively. In this way, since it is considered that the danger of the life or the body of the occupant 5 who has fallen into water is imminent when the fall-into-water place is not in the gentle state, the fall-into-water accident notification is transmitted immediately, and the security operator 71 is requested to dispatch a rescue squad.

On the other hand, when the fall-into-water place at the present time is in the gentle state (step S7: YES), the notification controller 19 starts timing by using, for example, a timer built in the main controller 16 (step S9). Subsequently, the notification controller 19 determines whether the weight applied to the bottom surfaces of the feet of the occupant 5 is equal to or greater than the second weight reference value K2 (step S10). In this step, the method of obtaining the weight applied to the bottom surfaces of the feet of the occupant 5 is the same as step S3. If the weight applied to the bottom surfaces of the feet of the occupant 5 is not equal to or greater than the second weight reference value K2 (step S10: NO), the notification controller 19 refers to the value of the timer, and determines whether the hold set time has elapsed from the time when timing is started in step S9 (step S11). The hold set time is set in advance and stored in, for example, the memory 13 or the like. The hold set time may be arbitrarily set by a user. The hold set time is, for example, about 5 minutes to 20 minutes.

The notification controller 19 repeats the processes of steps S10 and S11 until it is determined that the weight applied to the bottom surfaces of the feet of the occupant 5 is equal to or greater than the second weight reference value K2 or until the hold set time has elapsed from the time when timing is started. In this way, while the processes of steps S10 and S11 are repeated, the transmission of the fall-into-water accident notification is held. When the fall-into-water place is in the gentle state as described above, there is a sufficient possibility that the occupant 5 who has fallen into water can return to the vessel 2 by himself or herself, and thus the transmission of the fall-into-water accident notification is held until the hold set time elapses.

Then, when it is determined that the weight applied to the bottom surfaces of the feet of the occupant 5 becomes equal to or greater than the second weight reference value K2 before the hold set time elapses from the time when timing is started (step S10: YES), the notification controller 19 cancels the transmission of the fall-into-water accident notification and ends the fall-into-water accident determination process. That is, when the weight applied to bottom surfaces of the feet of the occupant 5 becomes equal to or greater than the second weight reference value K2, the occupant 5 returns to the vessel 2 from the water surface and stands on the floor surface of the vessel 2. In this case, it is considered that the life or body of the occupant 5 is out of danger, and it is unnecessary to dispatch the rescue squad to rescue the occupant 5, so that the fall-into-water accident notification is not transmitted.

On the other hand, when it is not determined that the weight applied to the bottom surfaces of the feet of the occupant 5 is equal to or greater than the second weight reference value K2, and the hold set time has elapsed (step S11: YES), the notification controller 19 transmits the fall-into-water accident notification (step S8). The occupant 5 who has fallen into water in this case is in a state of not being able to return to the vessel 2 after falling into water. Specifically, as shown in FIG. 6A or 6B, the fall-into-water place is deep, and the occupant is floating in the water with both feet not reaching the ground in the underwater; or as shown in FIG. 6C, the fall-into-water place is shallow, and the occupant is standing on the ground in the underwater. In either case, if the occupant 5 cannot return to the vessel 2, it is considered that the life or body of the occupant 5 is in danger even when the fall-into-water place is in a gentle state. As an example, the occupant 5 is injured when falling from the vessel 2 to the water surface, so that the occupant 5 cannot return to the vessel 2 by himself or herself. By transmitting the fall-into-water accident notification after the hold set time has elapsed, it is possible to request the security operator 71 to dispatch a rescue squad for rescuing the occupant 5.

As described above, the fall-into-water accident determination system 1 is provided with the hold setting switch 37 which switches whether to hold the fall-into-water accident notification. The fall-into-water accident determination process shown in FIG. 7 is based on a premise that the mode of the fall-into-water accident determination system 1 is set to a mode in which the fall-into-water accident notification is held. When the occupant 5 operates the hold setting switch 37 and the mode of the fall-into-water accident determination system 1 is switched to a mode in which the fall-into-water accident notification is not held, the processes of steps S7, S9 to S11 in FIG. 7 are not executed. That is, when the occurrence of the fall-into-water accident is recognized, the process immediately proceeds from step S5 to step S8 regardless of whether the fall-into-water place is in the gentle state, and the fall-into-water accident notification is immediately transmitted. For example, if the occupant 5 feels unwell and it is expected to be difficult for the occupant 5 to return to the vessel 2 even if the fall-into-water place is in the gentle state when the occupant 5 falls into water from the vessel 2, by operating the hold setting switch 37 before departure, the mode of the fall-into-water accident determination system 1 is switched to the mode in which the fall-into-water accident notification is not held.

As described above, the fall-into-water accident determination system 1 is provided with the manual notification button 38. For example, even in a case where a plurality of occupants are on the vessel 2 which is leaving the shore and one of the plurality of occupants falls into water from the vessel 2, even if the transmission of the fall-into-water accident notification is held because the fall-into-water place is in the gentle state, when another occupant on the vessel 2 presses the manual notification button 38, the fall-into-water accident notification is immediately transmitted.

As described above, according to the fall-into-water accident determination system 1 of the first embodiment of the present invention, it is determined whether the weight applied to the bottom surfaces of the feet of the occupant 5 changes, and whether the occupant 5 is immersed in water. Since it is determined that the occupant 5 falls into water from the vessel 2 based on these two determination results, it is possible to accurately determine that the occupant 5 falls into water from the vessel 2. Specifically, it is possible to accurately distinguish between the case where the occupant 5 sits on the chair 4 or the like with the bottom surfaces of both feet separated from the floor surface and the case the occupant 5 falls into water from the vessel 2, between the case where the occupant 5 tumbles on the floor surface of the vessel 2 and the case where the occupant 5 falls into water from the vessel 2, and between the case where the occupant 5 is exposed to a large amount of water while being on the vessel 2 and the case where the occupant 5 falls into water from the vessel 2. Based on such accurate determination of fall-into-water, it is possible to accurately determine the occurrence of the fall-into-water accident.

Further, in determining the occurrence of the fall-into-water accident, the fall-into-water accident determination system 1 according to the first embodiment of the present invention determines whether the weight applied to the bottom surfaces of the feet of the occupant 5 changes from the value greater than the first weight reference value K1 to the value equal to or less than the first weight reference value K1. As a result, it is possible to accurately recognize that the weight applied to the bottom surfaces of the feet of the occupant 5 changes from w1 (substantially equal to the weight of the occupant 5) to approximately 0 kg, and that the weight applied to the bottom surfaces of the feet of the occupant 5 changes from w2 to approximately 0 kg. By accurately recognizing the change in the weight applied to the bottom surfaces of the feet of the occupant 5, it is possible to accurately determine that the occupant 5 falls into water from the vessel 2.

Further, the fall-into-water accident determination system 1 according to the first embodiment of the present invention determines whether to immediately transmit the fall-into-water accident notification when the fall-into-water accident occurs based on the environmental information received by the external communicator 15. Specifically, when it is recognized that the fall-into-water place is not in the gentle state based on the environmental information, the fall-into-water accident determination system 1 immediately transmits the fall-into-water accident notification. When it is recognized that the fall-into-water place is in the gentle state based on the environmental information, the fall-into-water accident determination system 1 holds the fall-into-water accident notification until the hold set time elapses. When the weight applied to the bottom surfaces of the feet of the occupant 5 becomes equal to or greater than the second weight reference value K2 before the hold set time elapses, the fall-into-water accident determination system 1 cancels the transmission of the fall-into-water accident notification. According to the above configuration, when the fall-into-water place is not in the gentle state, the fall-into-water accident notification is immediately transmitted, and the occupant 5 who has fallen into water can be quickly rescued. On the other hand, when the fall-into-water place is in the gentle state, it is possible to hold the transmission of the fall-into-water accident notification and wait for the occupant 5 who has fallen into water to return to the vessel 2 by himself or herself. In addition, the transmission of the fall-into-water accident notification is canceled when the occupant 5 who has fallen into water returns to the vessel 2 while the transmission of the fall-into-water accident notification is held, so that unnecessary dispatch of the rescue squad can be avoided, and unnecessary concerns can be prevented from being given to the person related to the occupant 5.

Further, in the fall-into-water accident determination system 1 according to the first embodiment of the present invention, the weight detectors 25, 31 are provided on the soles of the left and right shoes 7, 8 worn by the occupant 5, respectively. With this configuration, the weight applied to the bottom surfaces of the feet of the occupant 5 can be accurately and easily detected. However, it is sufficient that at least one weight detector is provided on the sole of at least one of the left and right shoes 7, 8.

Further, in the fall-into-water accident determination system 1 according to the first embodiment of the present invention, the water detector 21 is provided in the wearing article of the occupant 5, specifically, the life jacket 6. With this configuration, it is possible to accurately and easily detect that the occupant 5 is immersed in water. Further, by using a water battery as the water detector 21, water can be easily detected.

The fall-into-water accident determination system 1 according to the first embodiment of the present invention stops the motor 3 of the vessel 2 when the fall-into-water accident occurs. With this configuration, it is possible to prevent the vessel 2 from being moved by the power of the motor 3 after the occupant has fallen into water, thereby preventing a distance between the vessel 2 and the occupant 5 from increasing. Further, since the rotation of the propeller stops due to the stop of the motor 3, the occupant 5 can be prevented from being pulled into the propeller of the vessel 2 after falling into water and coming into contact with the propeller rotating at a high speed, thereby preventing being injured.

In the fall-into-water accident determination system 1 according to the first embodiment of the present invention, the GPS receiver 11 and the memory 13 in which the map information 12 is stored are specific examples of a "position detector" described in the claims. The weight detectors 25, 31, the left weight detection controller 27, and the right weight detection controller 33 are specific examples of a "weight detector" described in the claims. The water detector 21 and the water detection controller 22 are specific examples of a "water detector" described in the claims. The external communicator 15 is a specific example of an "environmental information acquisitor" described in the claims. The notification controller 19 and the external communicator 15 are specific examples of a "notifier" described in the claims. Further, in FIG. 7, step S3 is a specific example of a "weight determination step" described in the claims, and step S4 is a specific example of an "immersion determination step" described in the claims.

Second Embodiment

Figure 8:
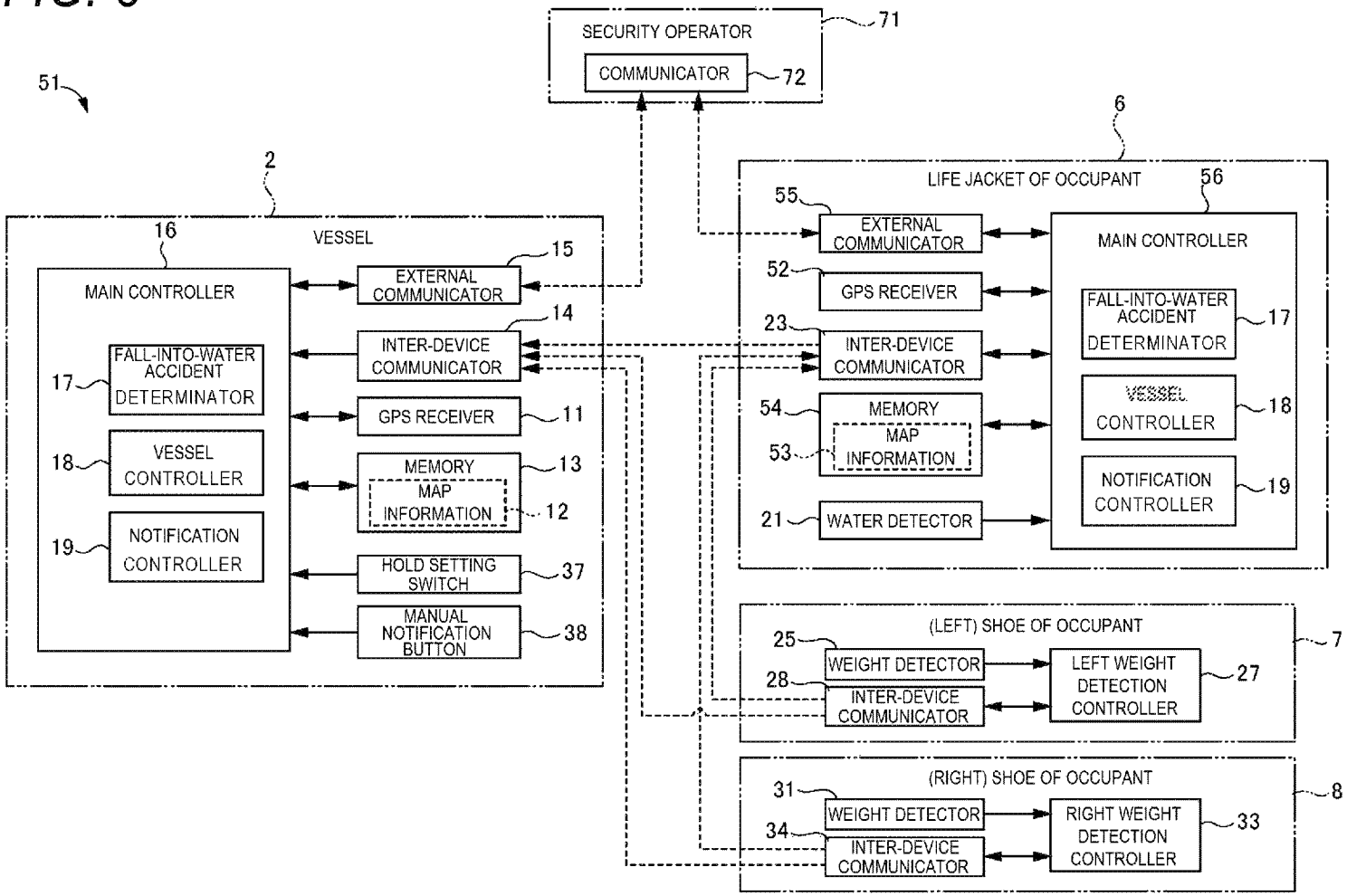
FIG. 8 is a block diagram showing a fall-into-water accident determination system according to a second embodiment of the present invention.

FIG. 8 shows a fall-into-water accident determination system 51 according to a second embodiment of the present invention. In the fall-into-water accident determination system 51 shown in FIG. 8, the same components as those of the fall-into-water accident determination system 1 according to the first embodiment shown in FIG. 1 are denoted by the same reference numerals, and description thereof is omitted. Dashed arrows in FIG. 8 indicate wireless signal paths.

As shown in FIG. 8, the feature of the fall-into-water accident determination system 51 according to the second embodiment is that, a GPS receiver 52, a memory 54 in which map information 53 is stored, an external communicator 55, and a main controller 56 are added to the fall-into-water accident determination system 1 according to the first embodiment, and these added devices are attached to the life jacket 6 worn by the occupant 5. That is, the fall-into-water accident determination system 51 according to the second embodiment includes two GPS receivers 11, 52, two memories 13, 54 in which the map information 12, 53 are stored respectively, two external communicators 15, 55, and two main controllers 16, 56. The GPS receiver 11, the memory 13, the external communicator 15, and the main controller 16 are provided in the vessel. The GPS receiver 52, the memory 54, the external communicator 55, and the main controller 56 are attached to the life jacket 6. The water detection controller 22 is provided in the life jacket 6 in the fall-into-water accident determination system 1 according to the first embodiment, but the water detection controller 22 is provided in the main controller 56 in the fall-into-water accident determination system 51 according to the second embodiment. That is, the main controller 56 has the function of the main controller 16 and the function of the water detection controller 22. Further, the GPS receiver 52, the memory 54, the external communicator 55, and the main controller 56 are housed in a case having a waterproof function, and are attached to the life jacket 6.

In the fall-into-water accident determination system 51 according to the second embodiment, all the steps of the fall-into-water accident determination process shown in FIG. 7 are independently performed by the main controller 16 provided in the vessel 2 and the main controller 56 attached to the life jacket 6. That is, the two main controllers 16, 56 execute processes such as determining whether the fall-into-water accident occurs, controlling of stopping the motor 3 of the vessel 2 at the occurrence of the fall-into-water accident, transmitting the fall-into-water accident notification, holding the fall-into-water accident notification based on the environmental information, and cancelling the transmission of the fall-into-water accident notification in parallel. The GPS receiver 11, the memory 13 (map information 12), and the external communicator 15 provided in the vessel 2 are used in the fall-into-water accident determination process by the main controller 16 provided in the vessel 2. On the other hand, the GPS receiver 52, the memory 54 (map information 53), and the external communicator 55 attached to the life jacket 6 are used in the fall-into-water accident determination process by the main controller 56 attached to the life jacket 6.

The main controller 56 attached to the life jacket 6 recognizes the position of the occupant 5 based on the signal received by the GPS receiver 52 from the GPS satellite and the map information 53 stored in the memory 54 in the fall-into-water accident determination process. Since the occupant 5 is on the vessel 2, the position of the occupant 5 can be regarded as the position of the vessel 2. The main controller 56 attached to the life jacket 6 determines whether the vessel 2 is leaving the shore based on the position of the occupant 5.

Similar effects as those of the fall-into-water accident determination system 1 according to the first embodiment of the present invention can also be obtained by the fall-into-water accident determination system 51 according to the second embodiment of the present invention having above configuration. Further, according to the fall-into-water accident determination system 51 of the second embodiment of the present invention, determining whether the fall-into-water accident occurs, controlling of stopping the motor 3 of the vessel 2, transmitting of the fall-into-water accident notification, or the like are doubly performed by the main controller 16 on the vessel side and the main controller 56 on the occupant side. Therefore when the occupant 5 falls into water, the vessel 2 can be reliably stopped, and if the fall-into-water place is not in the gentle state when the occupant 5 falls into water, the fall-into-water accident notification can be reliably and immediately transmitted.

In the fall-into-water accident determination system 51 according to the second embodiment of the present invention, the main controller 56 attached to the life jacket 6 can perform the fall-into-water accident determination process without performing communication between the occupant side and the vessel side. Therefore, even in a case where communication between the vessel 2 and the occupant 5 is difficult to be performed, it is possible to reliably determine the occurrence of the fall-into-water accident and to transmit the fall-into-water accident notification.

Third Embodiment

Figure 9:
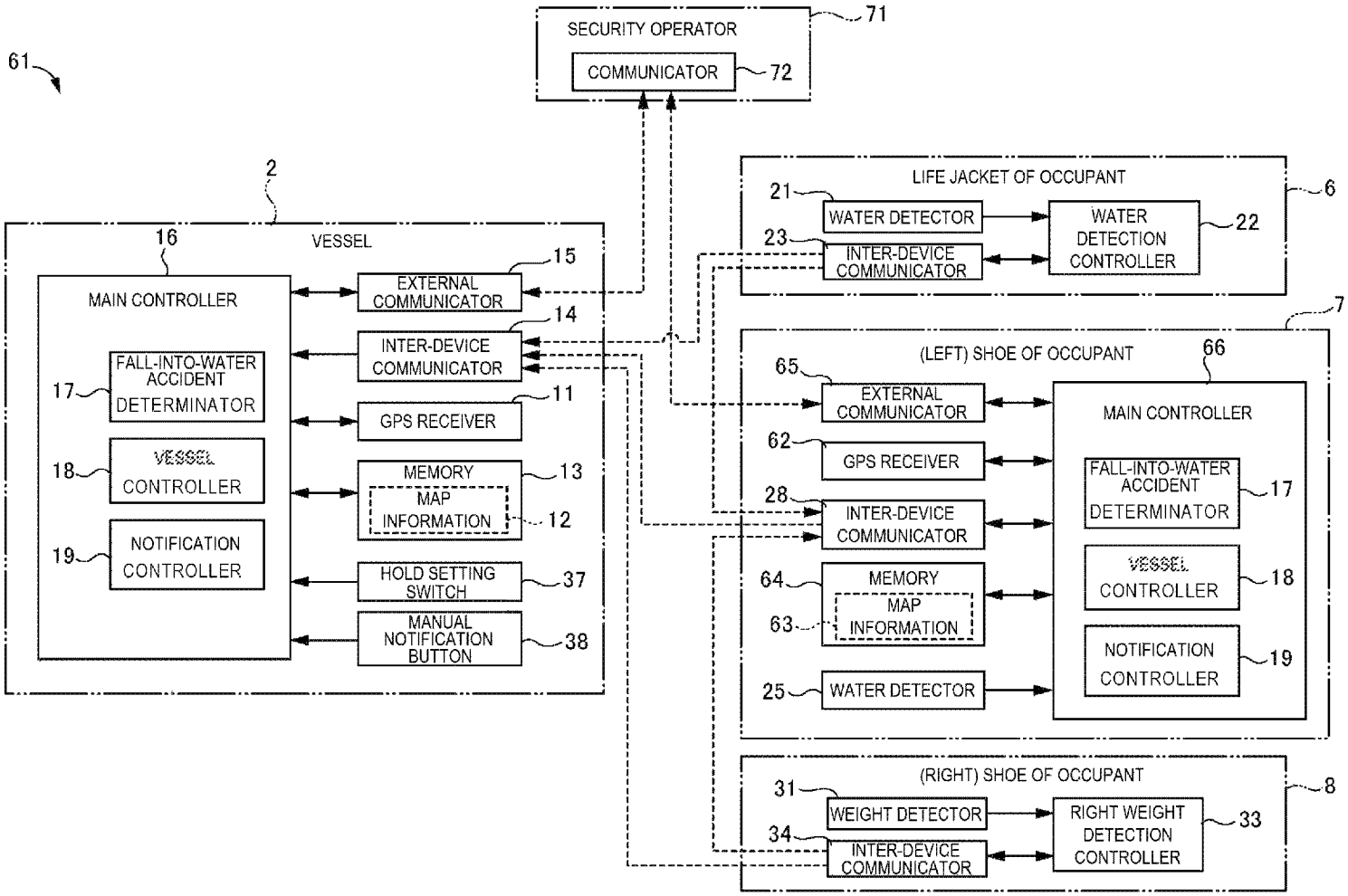
FIG. 9 is a block diagram showing a fall-into-water accident determination system according to a third embodiment of the present invention.

FIG. 9 shows a fall-into-water accident determination system 61 according to a third embodiment of the present invention. In the fall-into-water accident determination system 61 shown in FIG. 9, the same components as those of the fall-into-water accident determination system 1 according to the first embodiment shown in FIG. 1 are denoted by the same reference numerals, and description thereof is omitted. Dashed arrows in FIG. 9 indicate wireless signal paths.

In FIG. 9, similar to the fall-into-water accident determination system 51 according to the second embodiment, in the fall-into-water accident determination system 61 according to the third embodiment, the GPS receiver 62, the memory 64 in which map information 63 is stored, the external communicator 65, and the main controller 66 are added to the fall-into-water accident determination system 1 according to the first embodiment. However, in the fall-into-water accident determination system 61 according to the third embodiment, unlike the fall-into-water accident determination system 51 according to the second embodiment, the added GPS receiver 62, the memory 64, the external communicator 65, and the main controller 66 are attached to the left shoe 7 worn by the occupant 5. The left weight detection controller 27 is provided in the left shoe 7 in the fall-into-water accident determination system 1 according to the first embodiment, but the left weight detection controller 27 is provided in the main controller 66 in the fall-into-water accident determination system 61 according to the third embodiment. That is, the main controller 66 has the function of the main controller 16 and the function of the left weight detection controller 27. Further, the GPS receiver 62, the memory 64, the external communicator 65, and the main controller 66 are housed in a case having a waterproof function, and are attached to the left shoe 7.

In the fall-into-water accident determination system 61 according to the third embodiment, all the steps of the fall-into-water accident determination process shown in FIG. 7 are performed independently and in parallel by the main controller 16 provided in the vessel 2 and the main controller 66 attached to the left shoe 7. Further, the main controller 66 attached to the left shoe 7 recognizes the position of the occupant 5 by the GPS receiver 62 in the fall-into-water accident determination process. Since the occupant 5 is on the vessel 2, the position of the occupant 5 can be regarded as the position of the vessel 2. The main controller 66 determines whether the vessel 2 is leaving the shore based on the position of the occupant 5.

Similar effects as those of the fall-into-water accident determination system 1 according to the first embodiment of the present invention and the fall-into-water accident determination system 51 according to the second embodiment of the present invention can also be obtained by the fall-into-water accident determination system 61 according to the third embodiment of the present invention having such a configuration.

In the third embodiment shown in FIG. 9, the GPS receiver 62, the memory 64, the external communicator 65, and the main controller 66 may be attached to the right shoe 8 instead of the left shoe 7.

Further, in the first embodiment shown in FIG. 1, the water detector 21 may be attached to the left shoe 7, the function of the water detection controller 22 may be added to the left weight detection controller 27 to eliminate the water detection controller 22, and the function of the inter-device communicator 23 may be added to the inter-device communicator 28 to eliminate the inter-device communicator 23. Further, instead of this configuration, the water detector 21 may be attached to the right shoe 8, the function of the water detection controller 22 may be added to the right weight detection controller 33 to eliminate the water detection controller 22, and the function of the inter-device communicator 23 may be added to the inter-device communicator 34 to eliminate the inter-device communicator 23. Further, in the third embodiment shown in FIG. 9, the water detector 21 may be attached to the left shoe 7, the function of the water detection controller 22 may be added to the main controller 66 to eliminate the water detection controller 22, and the function of the inter-device communicator 23 may be added to the inter-device communicator 28 to eliminate the inter-device communicator 23. According to these configurations, the devices attached to the occupant 5 can be integrated into the shoes 7, 8.

Further, in each of the embodiments described above, the device attached to the life jacket 6 may not be provided in the life jacket 6 but in a coat, a glove, a hat, a watch, an accessory, or the like worn by the occupant 5.

In the second embodiment shown in FIG. 8, a device attached to the life jacket 6 may be provided in a portable terminal device such as a smartphone.

In each of the above embodiments, as an example, the inter-device communicator 28 that transmits the weight detection signal indicating the weight applied to the bottom surface of the left foot of the occupant 5 is attached to the left shoe 7, and the inter-device communicator 34 that transmits the weight detection signal indicating the weight applied to the bottom surface of the right foot of the occupant 5 is attached to the right shoe 8. However, the inter-device communicators 28, 34 may be attached to the life jacket 6, the coat, or the like. That is, when the posture of the occupant 5 who has fallen into water from the vessel 2 is in the supine position on the water surface 91 as shown in FIG. 6B, the inter-device communicators 28, 34 attached to the parts in the left and right shoes 7, 8 corresponding to shins of the feet are out of the water surface 91. Therefore, the extent to which propagation of radio waves from these inter-device communicators 28, 34 to the inter-device communicator 14 provided on the vessel 2 is hindered by water is small. On the other hand, as shown in FIG. 6A or 6C, when both feet of the occupant 5 who has fallen into water from the vessel 2 are fully submerged in the underwater 92, the inter-device communicators 28, 34 attached to the left and right shoes 7, 8 are located in the underwater. Therefore, the extent to which propagation of radio waves from these inter-device communicators 28, 34 to the inter-device communicator 14 provided on the vessel 2 is hindered by water is increased. In view of this, the inter-device communicators 28, 34 may be attached to the wearing article, such as the life jacket 6 or a coat, which is more likely to come out of the water surface than the shoes when the occupant 5 falls into water.

In the first embodiment shown in FIG. 1, the case where the environmental information is acquired from the external communicator 15 is exemplified. Alternatively or additionally, the vessel 2 may be provided with an anemometer, a wave height meter, a tidal current meter, or the like, and the wind speed, wave height, tide, or the like measured by these measuring devices may be used as environmental information. In each of the embodiments described above, a circuit or an apparatus other than the water battery may be used as the water detector 21.

Further, in each of the embodiments described above, the case where the occurrence of a fall-into-water accident is determined while the vessel 2 is leaving the shore is mainly exemplified. However, the present invention is not limited thereto. Although described above, the occurrence of a fall-into-water accident may also be determined while the vessel 2 is docked at the shore. In this case, the GPS receiver 52 (62), the memory 54 (64) in which the map information 53 (63) is stored are attached to the occupant as the fall-into-water accident determination system 51 (61) according to the second or third embodiment. Then, for example, in step S2 in FIG. 7, it is determined whether the occupant 5 moves from the shore to the vessel 2, and the process proceeds to step S3 when the occupant 5 moves from the shore to the vessel 2. In step S6, it is determined whether the occupant 5 moves from the vessel 2 to the shore, and when the occupant 5 moves from the vessel 2 to the shore, the fall-into-water accident determination process is ended.

Further, the present invention can be appropriately changed within a scope not contrary to the gist or idea of the present invention which can be read from the entire claims and the specification, and a fall-into-water accident determination system and a fall-into-water accident determination method with such a change are also included in the technical concept of the present invention.

What is claimed is:

1. A fall-into-water accident determination system comprising:

a weight detector configured to be attached to an occupant of a vessel and configured to detect a weight applied to a foot of the occupant;

a water detector configured to be attached to the occupant and configured to detect water; and a fall-into-water accident determinator configured to determine whether a fall-into-water accident in which the occupant falls into water from the vessel occurs, wherein the fall-into-water accident determinator determines whether the weight changes based on a detection result of the weight detector, wherein the fall-into-water accident determinator determines whether the occupant is immersed in water based on a detection result of the water detector, and wherein the fall-into-water accident determinator determines that the fall-into-water accident occurs when the weight changes and the occupant is immersed in water.

2. The fall-into-water accident determination system according to claim 1 further comprising:

a notifier configured to transmit a fall-into-water-accident notification that reports the fall-into-water accident; and an environmental information acquisitor configured to acquire environmental information including at least meteorologic information or hydrographic information of a place where the occupant falls into water, wherein the notifier determines whether the fall-into-water accident notification is immediately transmitted when the fall-into-water accident determinator determines that the fall-into-water accident occurs, based on the environmental information acquired by the environmental information acquisitor.

3. The fall-into-water accident determination system according to claim 2, wherein the notifier determines whether a place where the fall-into-water accident occurs is in a calm state based on the environmental information acquired by the environmental information acquisitor, and wherein the notifier suspends the transmission of the fall-into-water accident notification for a predetermined time from a time point when the fall-into-water accident determinator determines that the fall-into-water accident occurs, when the place where the fall-into-water accident occurs is in the calm state.

4. The fall-into-water accident determination system according to claim 3, wherein the notifier determines whether the occupant who has fallen into water returns to the vessel based on the weight detected by the weight detector until the predetermined time elapses from the time point when the fall-into-water accident determinator determines that the fall-into-water accident occurs, and wherein the notifier does not transmit the fall-into-water accident notification when the occupant who has fallen into water returns to the vessel until the predetermined time elapses from the time point when the fall-into-water accident determinator determines that the fall-into-water accident occurs.

5. The fall-into-water accident determination system according to claim 1, wherein the fall-into-water accident determinator determines that the fall-into-water accident occurs when the weight changes from a value equal to weight of the occupant to zero and the occupant is immersed in water.

6. The fall-into-water accident determination system according to claim 1 further comprising:

a position detector configured to detect a position of the vessel or a position of the occupant, wherein the fall-into-water accident determinator determines whether the vessel is leaving the shore based on a detection result of the position detector, and wherein the fall-into-water accident determinator determines that the fall-into-water accident occurs when the vessel is leaving the shore, the weight changes, and the occupant is immersed in water.

7. The fall-into-water accident determination system according to claim 1, wherein the weight detector is provided in a sole of a shoe worn by the occupant.

8. The fall-into-water accident determination system according to claim 7, wherein the fall-into-water accident determinator and the notifier are provided in the shoe.

9. The fall-into-water accident determination system according to claim 1, wherein the water detector is provided in a wearing article of the occupant.

10. The fall-into-water accident determination system according to claim 9, wherein the fall-into-water accident determinator and the notifier are provided in the wearing article.

11. The fall-into-water accident determination system according to claim 1, wherein the fall-into-water accident determinator and the notifier are provided in a smartphone or a mobile terminal device.

12. The fall-into-water accident determination system according to claim 1, wherein two of the fall-into-water accident determinators and two of the notifiers are provided, wherein one of the two fall-into-water accident determinators and one of the two notifiers are provided on the vessel, and wherein the other of the two fall-into-water accident determinators and the other of the two notifiers are attached to the occupant.

13. The fall-into-water accident determination system according to claim 1, wherein the water detector comprises a water battery configured to detect water.

14. The fall-into-water accident determination system according to claim 1 further comprising:

a vessel controller configured to stop the power of the vessel when the fall-into-water accident determinator determines that the fall-into-water accident occurs.

15. A fall-into-water accident determination method comprising:

a weight determination step of determining whether weight applied to a foot of an occupant of a vessel changes based on a detection result of a weight detector configured to be attached to the occupant of the vessel and configured to detect the weight; and an immersion determination step of determining whether the occupant is immersed in water based on a detection result of a water detector configured to be attached to the occupant and configured to detect water, wherein when it is determined that the weight changes in the weight determination step and it is determined that the occupant is immersed in water in the immersion determination step, it is determined that a fall-into-water accident in which the occupant falls into water from the vessel occurs.

* * * * *